US007083561B2

(12) United States Patent
Prüm

(10) Patent No.: US 7,083,561 B2
(45) Date of Patent: Aug. 1, 2006

(54) FOLDING DEVICE WITH A FIRST AND SECOND PARTIAL CYLINDER AND METHOD FOR OPERATING SUCH A FOLDING DEVICE

(75) Inventor: Sebastian Alois Prüm, Kaiserslautern (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 36 days.

(21) Appl. No.: 10/503,943

(22) PCT Filed: Feb. 18, 2003

(86) PCT No.: PCT/DE03/00491

§ 371 (c)(1),
(2), (4) Date: Aug. 18, 2004

(87) PCT Pub. No.: WO03/070612

PCT Pub. Date: Aug. 28, 2003

(65) Prior Publication Data

US 2005/0159285 A1 Jul. 21, 2005

(30) Foreign Application Priority Data

Feb. 18, 2002 (DE) ..... 102 06 578

(51) Int. Cl.
*B31F 1/08* (2006.01)

(52) U.S. Cl. ..... 493/424; 493/428

(58) Field of Classification Search ..... 493/428, 493/424, 432, 476

See application file for complete search history.

(56) References Cited

U.S. PATENT DOCUMENTS

| | | | | |
|---|---|---|---|---|
| 5,057,064 | A | 10/1991 | Michalik | |
| 5,120,049 | A | 6/1992 | Fischer | |
| 5,520,378 | A * | 5/1996 | Kepert et al. | 270/8 |
| 5,676,630 | A | 10/1997 | Mayr | |
| 5,901,647 | A | 5/1999 | Kohlmann | |
| 6,019,714 | A * | 2/2000 | Stab | 493/429 |
| 6,358,192 | B1 * | 3/2002 | Michalik | 493/424 |
| 6,367,792 | B1 * | 4/2002 | Chagnon | 270/5.02 |
| 6,776,750 | B1 * | 8/2004 | Stieler et al. | 493/424 |
| 6,846,279 | B1 * | 1/2005 | Stieler et al. | 493/424 |
| 6,895,858 | B1 * | 5/2005 | Kostiza et al. | 101/219 |
| 2002/0177514 | A1 | 11/2002 | Stieler et al. | |
| 2002/0185022 | A1 | 12/2002 | Stieler et al. | |

FOREIGN PATENT DOCUMENTS

| | | |
|---|---|---|
| DE | 295 07 222 U1 | 8/1995 |
| DE | 197 55 428 A1 | 6/1999 |
| DE | 101 28 122 A1 | 12/2002 |
| EP | 1 260 474 A1 | 5/2002 |
| EP | 1 264 689 A2 | 6/2002 |
| GB | 1194451 | 6/1970 |

* cited by examiner

*Primary Examiner*—Sameh H. Tawfik
(74) *Attorney, Agent, or Firm*—Jones, Tullar & Cooper, P.C.

(57) ABSTRACT

A folding device includes a first partial cylinder and a second partial cylinder. These two partial cylinders form a cylinder body. The two partial cylinders are rotatable relative to each other and each partial cylinder includes first and second groups of functional elements distributed around the circumference of the partial cylinder. Each of the first and second partial cylinders is provided with its own dedicated drive motor to accomplish the rotational movement of each partial cylinder.

30 Claims, 14 Drawing Sheets

FOLDING DEVICE WITH A FIRST AND SECOND PARTIAL CYLINDER AND METHOD FOR OPERATING SUCH A FOLDING DEVICE

CROSS-REFERENCE TO RELATED APPLICATIONS

This application is the U.S. National phase under 35 U.S.C. 371 of PCT/DE03/00491, filed Feb. 18, 2003; published as WO 03/070612A1 on Aug. 28, 2003 and claiming priority to DE 102 06 578.0, filed Feb. 18, 2002, the disclosures of which are expressly incorporated herein by reference.

FIELD OF THE INVENTION

The present invention is directed to a folding device with a first and a second partial cylinder. The two partial cylinders, which together constitute a body of a cylinder, are coaxially rotatable relative to each other.

BACKGROUND OF THE INVENTION

A folding device generally has a folding or a transport cylinder, which has a first group of function elements, such as spur needle strips or sheet grippers, for example, for use in holding paper which is to be processed, against the cylinder. It also has, as a second group of function elements, a folding blade which, working together with folding rollers or with a folding jaw of a further cylinder, creates a fold in the paper conveyed on the folding cylinder.

In order to be able to process paper of different formats, or to form different folds, the function elements such as the spur needle strips or the sheet grippers of a folding cylinder, which are used for holding the paper to be processed, and the folding blades, are mounted on different partial cylinders. These partial cylinders have, in respect to each other, a defined freedom of rotary movement in relation to the shaft of the folding cylinder.

DE 197 55 428 A1 and DE 295 02 222 U1 both disclose folding cylinders which each have two cylinder bodies supporting folding mechanisms, which two cylinder bodies can be rotated in relation to each other.

Later published EP 1 264 689 A2 and EP 1 260 474 A1 both describe folding devices with a first and a second partial cylinder, which together constitute a body of the cylinder and which are rotatable relative to each other, and each one of which supports a first or a second group of function elements, which are distributed over the circumference of the cylinder, wherein its own drive motor for rotatory driving the partial cylinder is assigned to each partial cylinder.

U.S. Pat. No. 5,057,064 describes a folding jaw cylinder driven by a gear wheel. The two partial cylinders, which support folding jaws, are driven by a different motor only for the purpose of displacing them relative to each other in the circumferential direction.

U.S. Pat. No. 5,120,049 shows a multi-part bucket wheel, whose parts have different gear mechanisms.

SUMMARY OF THE INVENTION

The object of the present invention is directed to providing a folding device having a first and a second partial cylinder.

In accordance with the present invention, the object is attained by the provision of a folding device with first and second partial cylinders, each of which has radial segments. The two partial cylinders constitute a body of a cylinder and are rotatable with respect to each other. Each partial cylinder supports one of first and second groups of function elements. Each partial cylinder has its own electrical motor which, in its clear layout, is independent of other cylinders for the coaxial rotatory driving of its associated partial cylinder. The folding device has a driver circuit for driving the electrical motors at identical speeds and an adjustable relative phase position.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
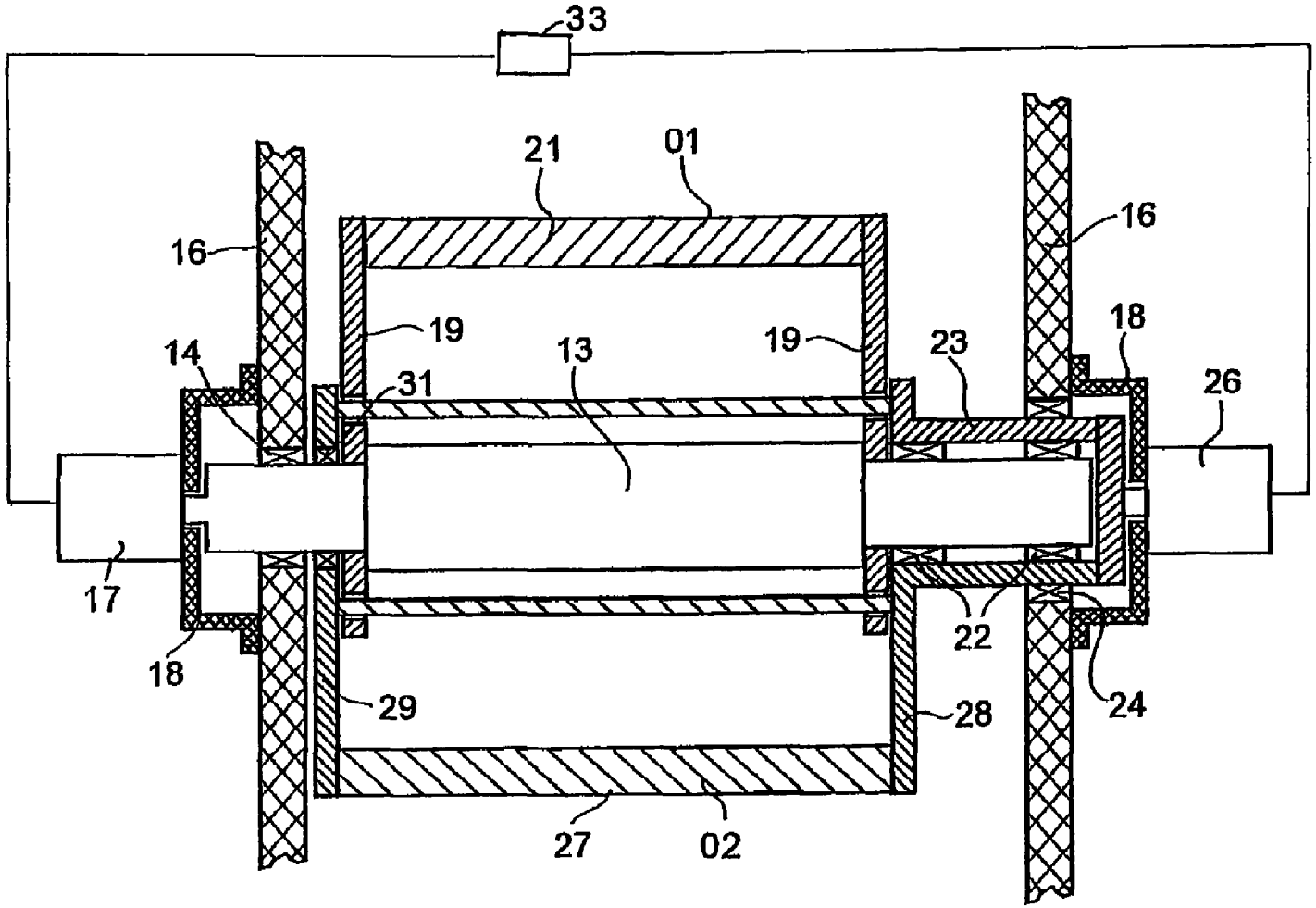
FIG. 1, a cross-sectional view through a cylinder and adjoining parts of a material-processing machine in accordance with the present invention and taken along line I—I of FIG. 2, in FIG. 2, an end view of the cylinder in FIG. 1, in FIG. 3, a first embodiment of a folding device, in FIG. 4, a second embodiment of a folding device, in FIG. 5, a third embodiment of a folding device, in FIG. 6, a fourth embodiment of a folding device, in FIG. 7, a folding device for accomplishing a transverse fold, in FIG. 8, a side elevation view of a folding device in accordance with FIG. 7, in FIG. 9, a folding device for accomplishing a transverse fold with a belt system, in FIG. 10, a side elevation view of a folding device in accordance with FIG. 9, in FIG. 11, a folding device for accomplishing a transverse fold with a linear fold, in FIG. 12, a side elevation view of a folding device in accordance with FIG. 11, in FIG. 13, a folding device for accomplishing a second transverse fold with a linear fold, and in FIG. 14, a side elevation view of a folding device in accordance with FIG. 13.

An axial section through a cylinder, as well as portions of lateral plates of a frame of a machine into which the cylinder has been placed, are shown in FIG. 1. The axial section extends along the dash-dotted line identified by I—I in FIG. 2.

Two partial cylinders 01, 02, of which the body of the cylinder represented in FIG. 1 is composed, are depicted in FIG. 1 using different hatching, with these hatchings rising for the first partial cylinder 01 and descending for the second partial cylinder 02. A central shaft 13 is part of the first partial cylinder 01. Central shaft 13 is supported at one or a first location, such as at the left in FIG. 1, by a bearing 14, for example by a rolling bearing 14, in a first lateral frame plate 16 of a folding device. The central shaft 13 can be driven by a first drive motor 17, whose motor housing is fixedly connected with the lateral frame plate 16 by the use of a flange 18. Two arms 19, which are fastened on the central shaft 13, support a first cylinder segment 21, which constitutes a portion of the circumferential surface of the cylinder and which first cylinder segment 21 supports a function element of a first group, for example a holding element, and in particular a strip, which is not specifically represented, with spur needles, or at least one gripper.

Figure 2:
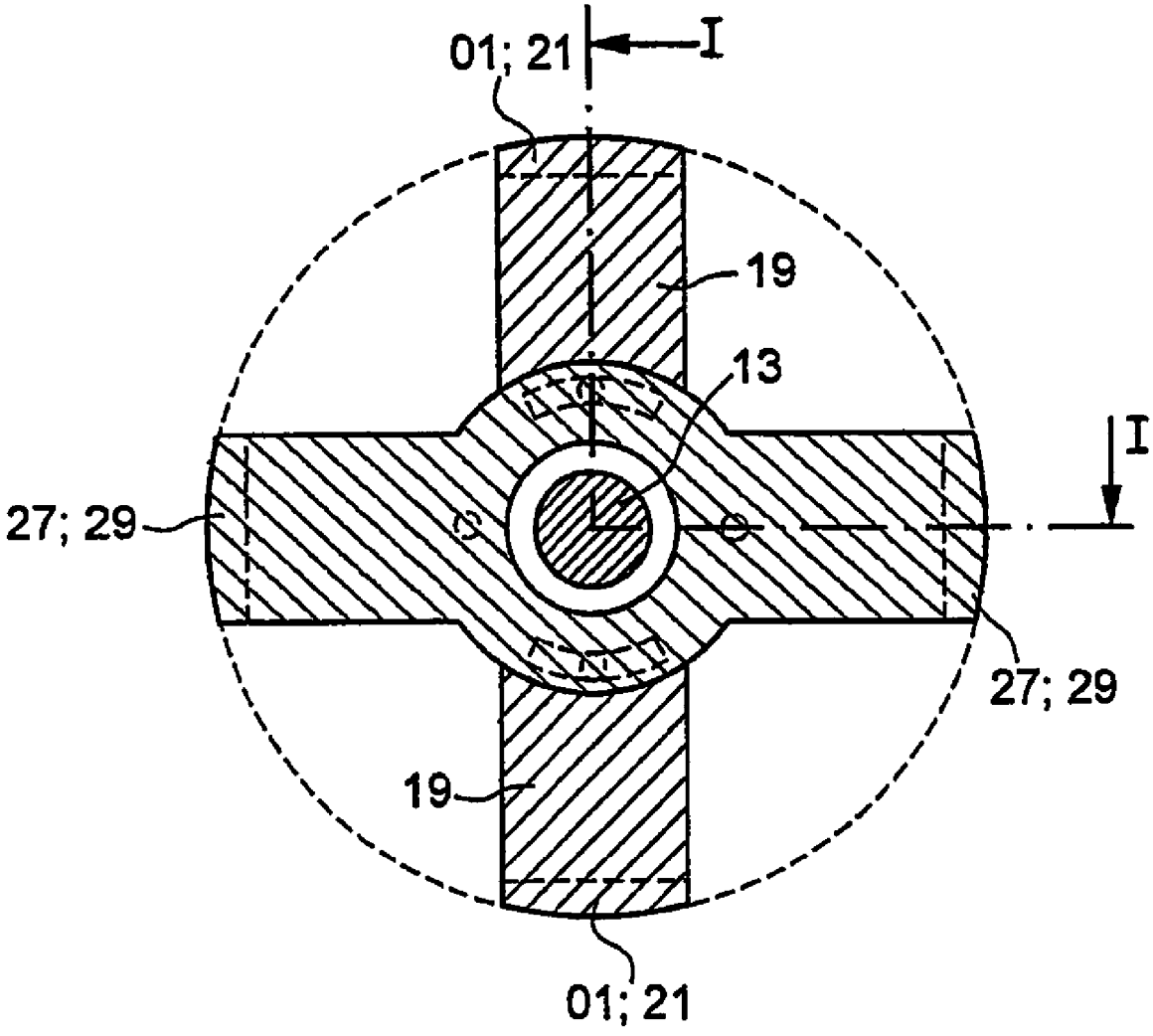

As can be seen in FIG. 2, the first partial cylinder 01 has two pairs of arms 19 and two first cylinder segments 21, which are located diametrically opposite each other. Of course, a larger number of first cylinder segments 21 can be arranged, evenly distributed in the circumferential direction.

The opposite or second end of the central shaft 13 is rotatably seated, with the aid of bearings 22, for example rolling bearings 22, in a cup 23, which cup 23 is a part of the second partial cylinder 02, which cup 23 is itself rotatably maintained in a second lateral frame plate 16 by a bearing 24, for example a rolling bearing 24. A driveshaft of a second drive motor 26, whose housing is fastened, in a manner similar to that of the first drive motor 17, on the lateral frame plate 16 by a flange 18, acts on the end or bottom of the cup 23.

Second cylinder segments 27 of the second partial cylinder 02 are each supported by two radial arms 28, 29, of which one arm 28 is secured to an open rim of the cup 23, and the other arm 29 is rotatably supported at the central shaft 13 by the use of a bearing 31, for example a rolling bearing 31. Each second cylinder segment supports a function element, which is not specifically represented, for example a folding blade.

The two drive motors 17, 26 are connected with a common control circuit 33 which, for example with the help of suitable rpm or angle sensors which may be arranged on the respective drive motors 17, 26, regulates both drive motors 17, 26 to run at identical rotational speeds, and therefore to maintain a constant distance between the function elements on the first or second cylinder segments 21 or 27, respectively.

In accordance with a simple embodiment of the present invention, the control circuit 33 is connected with two angle of rotation sensors that are arranged on the drive motors 17 and 26, each of which angle of rotation sensor provides a pulse to the control circuit 33 for each angle of rotation unit of the respective drive motor 17 or 26 traveled. The control circuit 33 is laid out for detecting the phase difference of the pulse trains provided by the two sensors and for maintaining it constant at a predetermined value, which predetermined value can be adjusted at the control circuit 33, and which predetermined value corresponds to a desired distance between the function elements on the two partial cylinders 01, 02.

In place of simple pulses, each of the sensors may provide binary-coded data words in a fixed cyclic sequence. This makes it possible for the control circuit 33 to detect a phase shift between two identical data words from the two respective sensors and to keep it constant, even if the time difference is greater than the period at which the data words are delivered.

It is obvious that the present invention can be utilized with any arbitrary type of function elements situated on the first and second partial cylinders 01, 02. The function elements on the first and second partial cylinders 01, 02 can be of different types, or also can be of the same type. They can be spur needles or spur needle strips, sheet grippers, folding blades, folding jaws, ejectors, post-grippers, cutting blades, and the like.

The cylinder which includes the first and second partial cylinders 01 and 02 can be embodied in a folding device as a folding blade cylinder, as a folding jaw cylinder or as a collection cylinder, for example.

Figure 3:
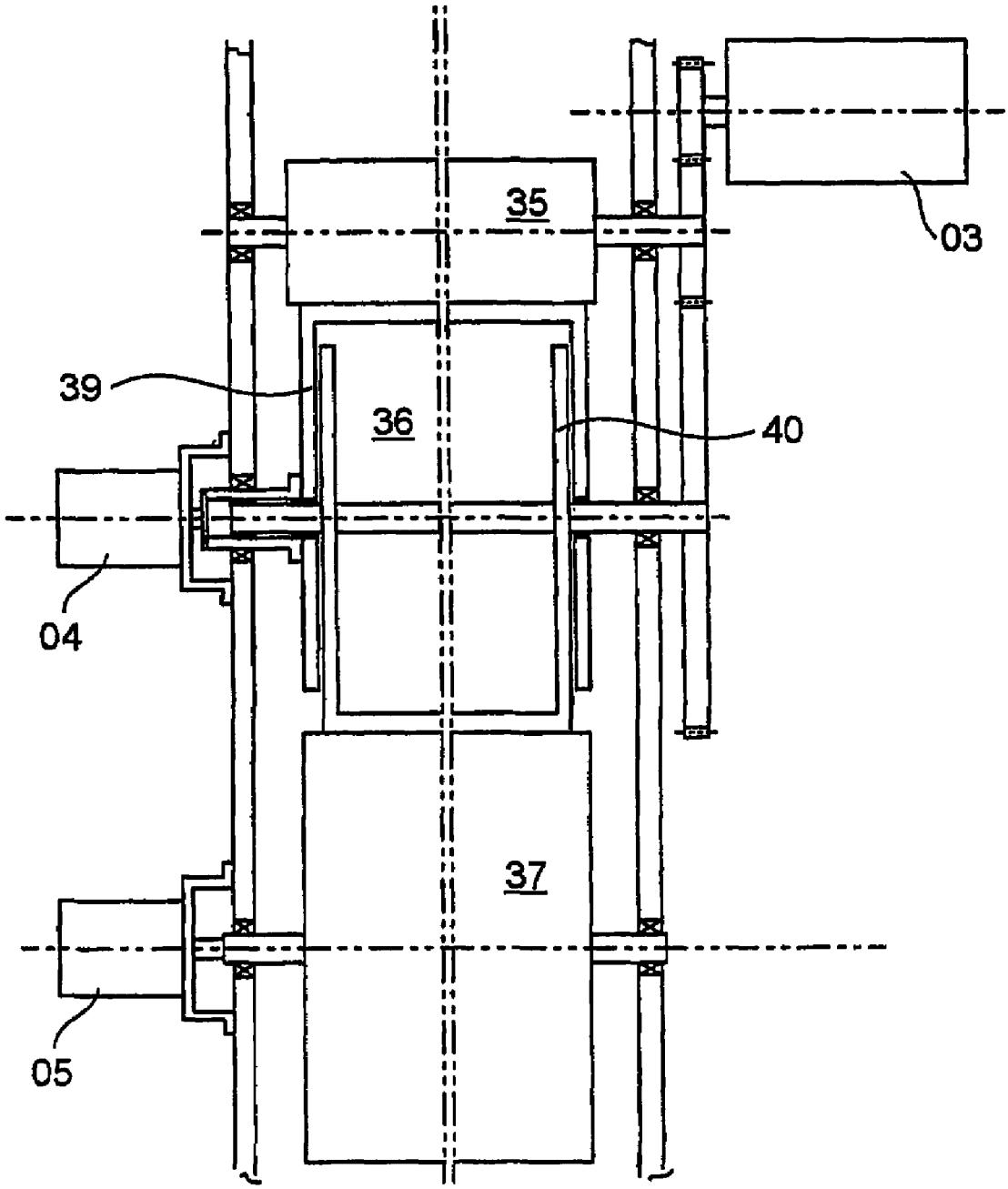

In one preferred embodiment of the present invention, as see in FIG. 3, the folding device has at least one cutting cylinder 35, a collection cylinder 36 and a folding jaw cylinder 37. The collection cylinder 36 has two partial cylinders 39, 40, which first and second partial cylinders 39, 40 can be displaced in relation to each other in the circumferential direction. The first partial cylinder 39 is provided with at least one folding blade as its function element, and the second partial cylinder 40 is provided with spur needles or grippers as its function element. This collection cylinder 36 transfers signatures to the folding jaw cylinder 37.

The folding jaw cylinder 37 is driven by its own electric motor 05 and is mechanically independently of other cylinders. The first partial cylinder 39 of the collection cylinder 36, which carries the folding blade, is driven by another electric motor 04. The other or second partial cylinder 40 of the collection cylinder, and supporting the spur needles or grippers, is driven by a further electric motor 03, which electric motor 03 also drives the cutting cylinder 35. A gear drive with several gear wheels is provided for this drive of the second partial cylinder 40 and the cutting cylinder 35. One gear wheel is connected with the second partial cylinder 40 supporting the spur needles or grippers, a second gear wheel is connected with the cutting cylinder 35, and a third gear wheel is connected with the rotor of the electric motor 03. For accomplishing driving of the cylinder and partial cylinders, the electric motor 03, the cutting cylinder 35 and the partial cylinder 40 of the collection cylinder 36 are connected by the gear wheels, wherein driving takes place from the cutting cylinder 35 to the collection cylinder 36. The electric motor 03 assigned to the cutting cylinder 35 and to the partial cylinder 40 of the collection cylinder 36 is arranged on one side of the folding device, while the electric motors 04 assigned to the partial cylinder 39 supporting the folding blades of the collection cylinder 36 and to the folding jaw cylinder 37 are arranged on the opposite side of the folding device.

Figure 4:
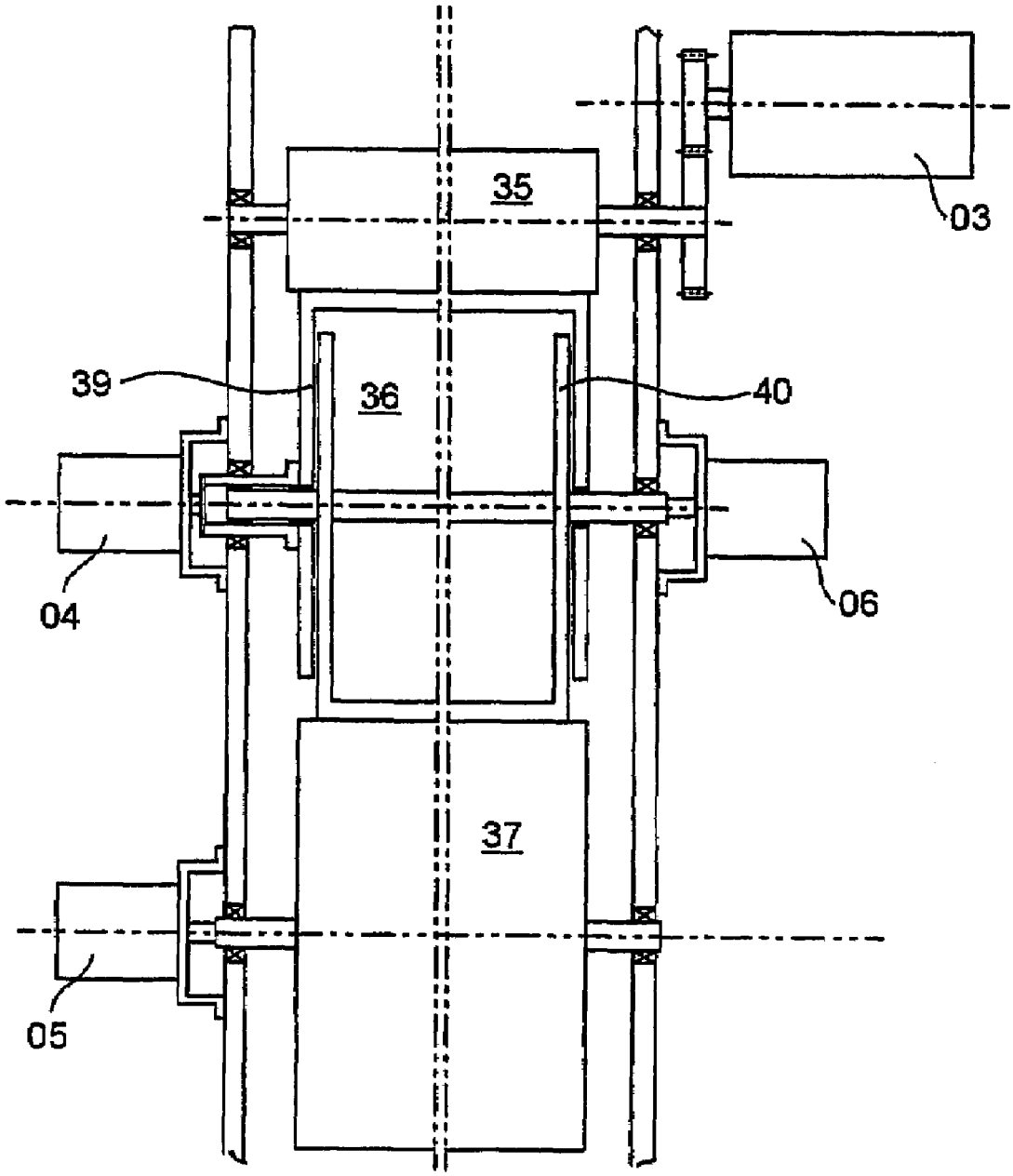

As represented in FIG. 4, in place of the gear wheel connection between the cutting cylinder 35 and the partial cylinder 40 of the collection cylinder 36, this partial cylinder 40 is, in the configuration, also provided with its own electric motor 06. A transmission gear can be arranged between the cutting cylinder 35 and the electric motor 03, so that the electric motor 03 can be arranged offset with respect to the axis of the cutting cylinder 35.

Figure 5:
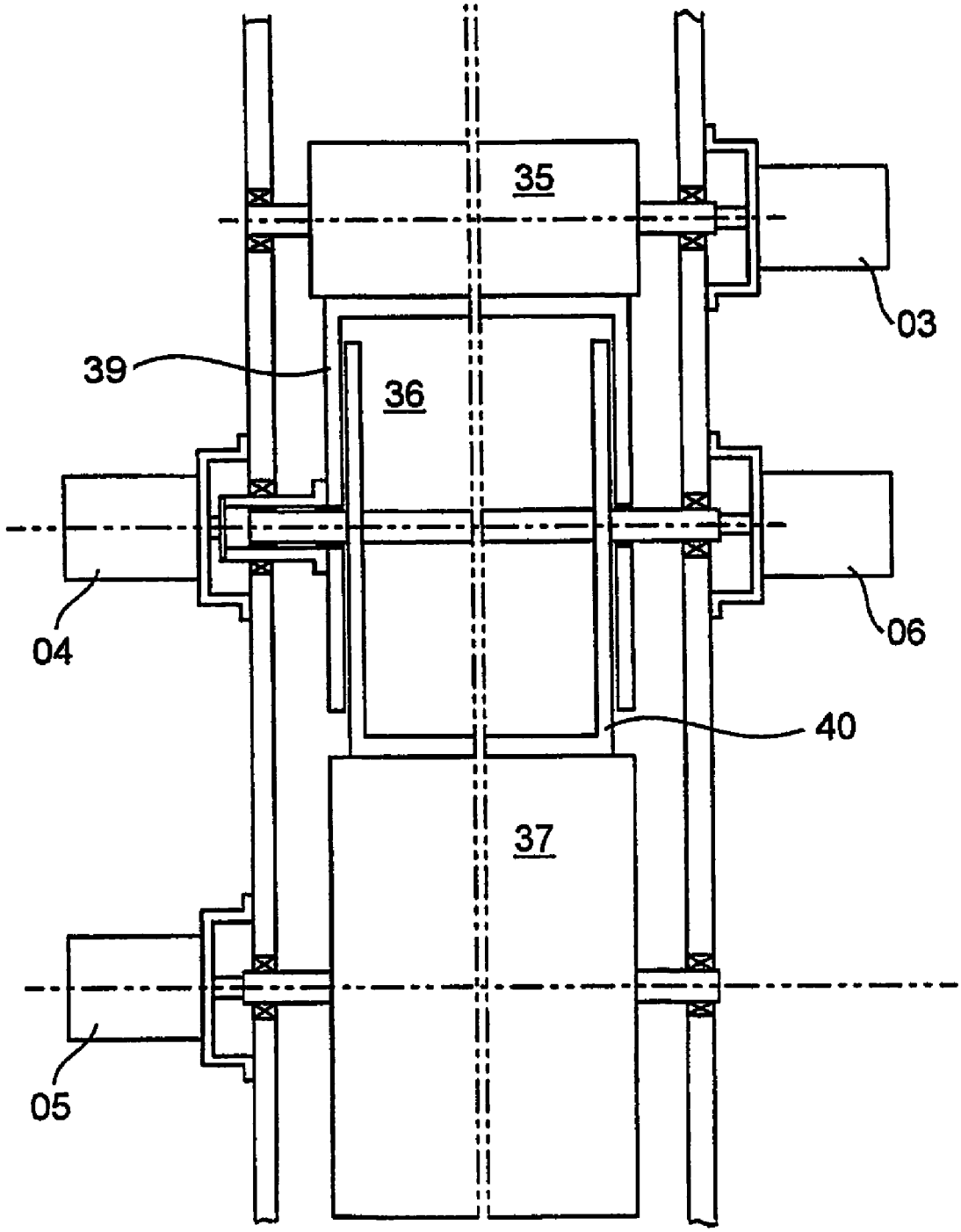

It is also possible, as depicted in FIG. 5, to arrange the electric motor 03 of the cutting cylinder 35 coaxially with respect to the cutting cylinder 35, as seen in FIG. 5. In this configuration the rotor of the electric motor 03 can be connected with the shaft of the cutting cylinder 35 without a gear. Alternatively, an auxiliary gear, such as a planetary gear can be arranged between cylinder 35 and motor 03.

Figure 6:
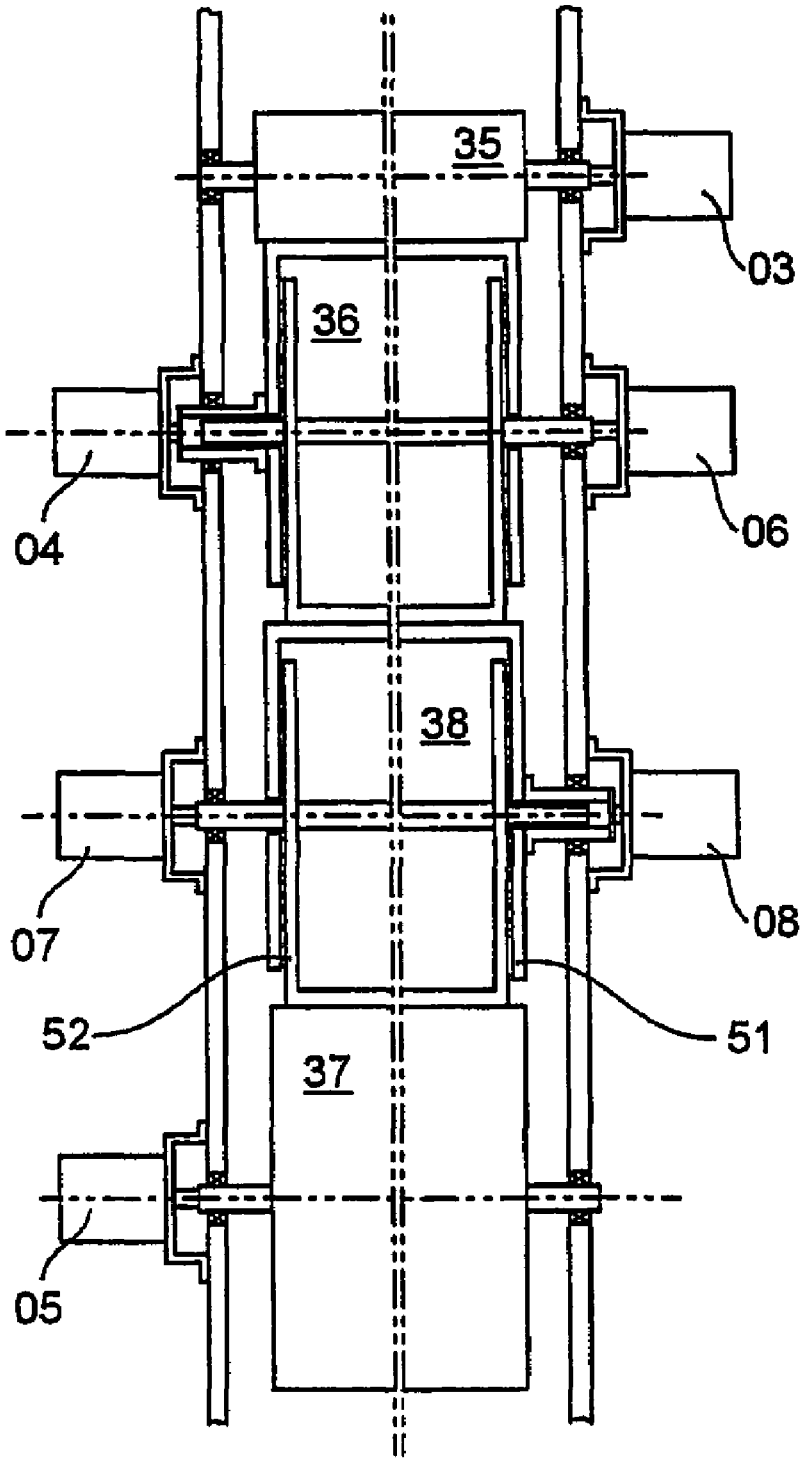

As represented in FIG. 6, a further folding cylinder 38, which has first and second partial cylinders 51, 52, is arranged between the collection cylinder 36 and the folding jaw cylinder 37. The first partial cylinder 51 of the further folding cylinder 36 has at least one folding blade, and the second partial cylinder 52 of the further folding cylinder 38 has at least one folding jaw. In this embodiment, each one of the first and second partial cylinders 51, 52 is driven by its own electric motor 07, 08.

In embodiments with electric motors which are arranged concentrically with respect to the axis of rotation of the associated cylinder or partial cylinder, the rotor of the electric motor can be directly connected with the shaft of the cylinder. Alternatively, the motor can have a auxiliary gear, for example a planetary gear.

Figure 7:
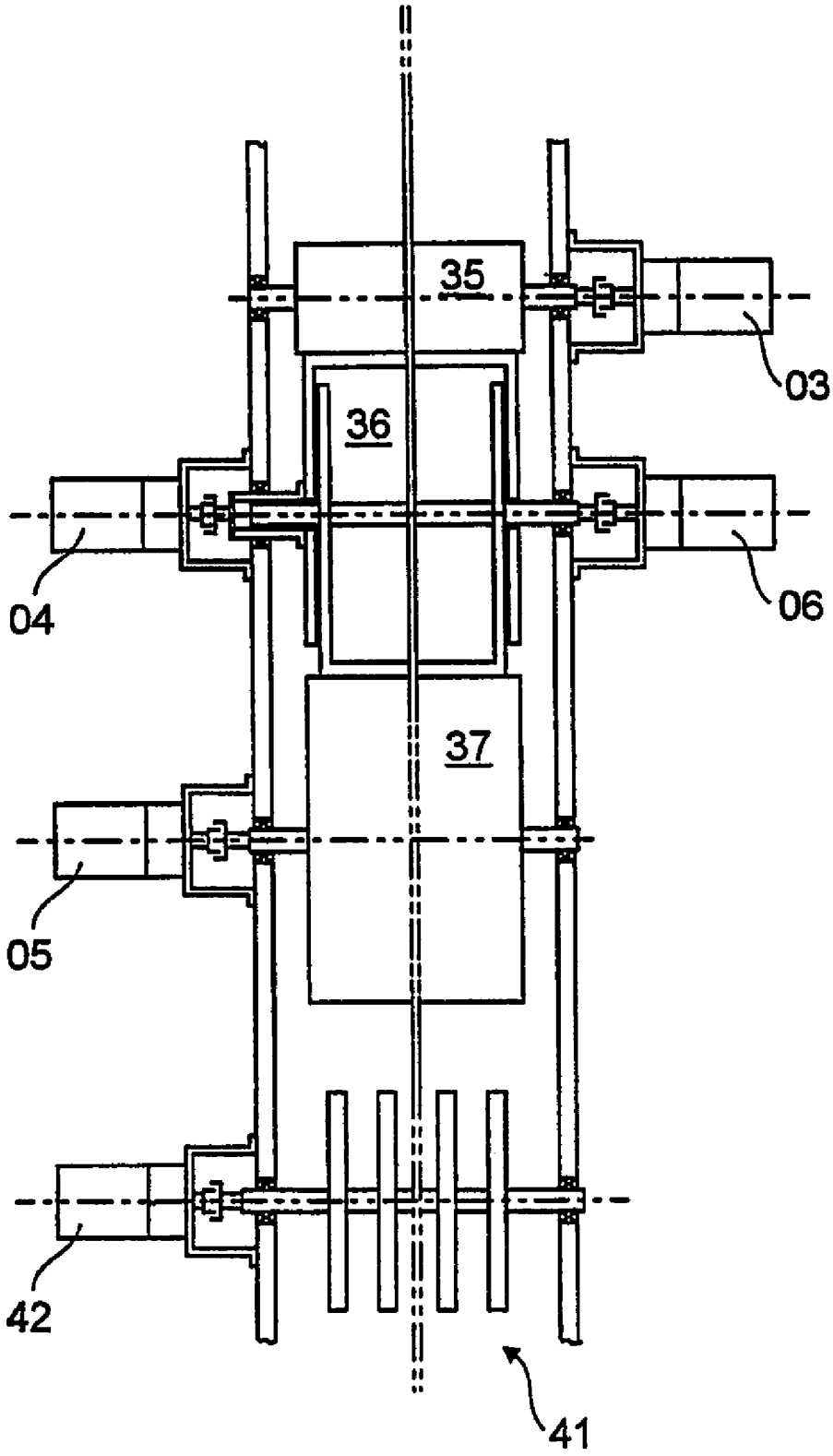
Figure 8:
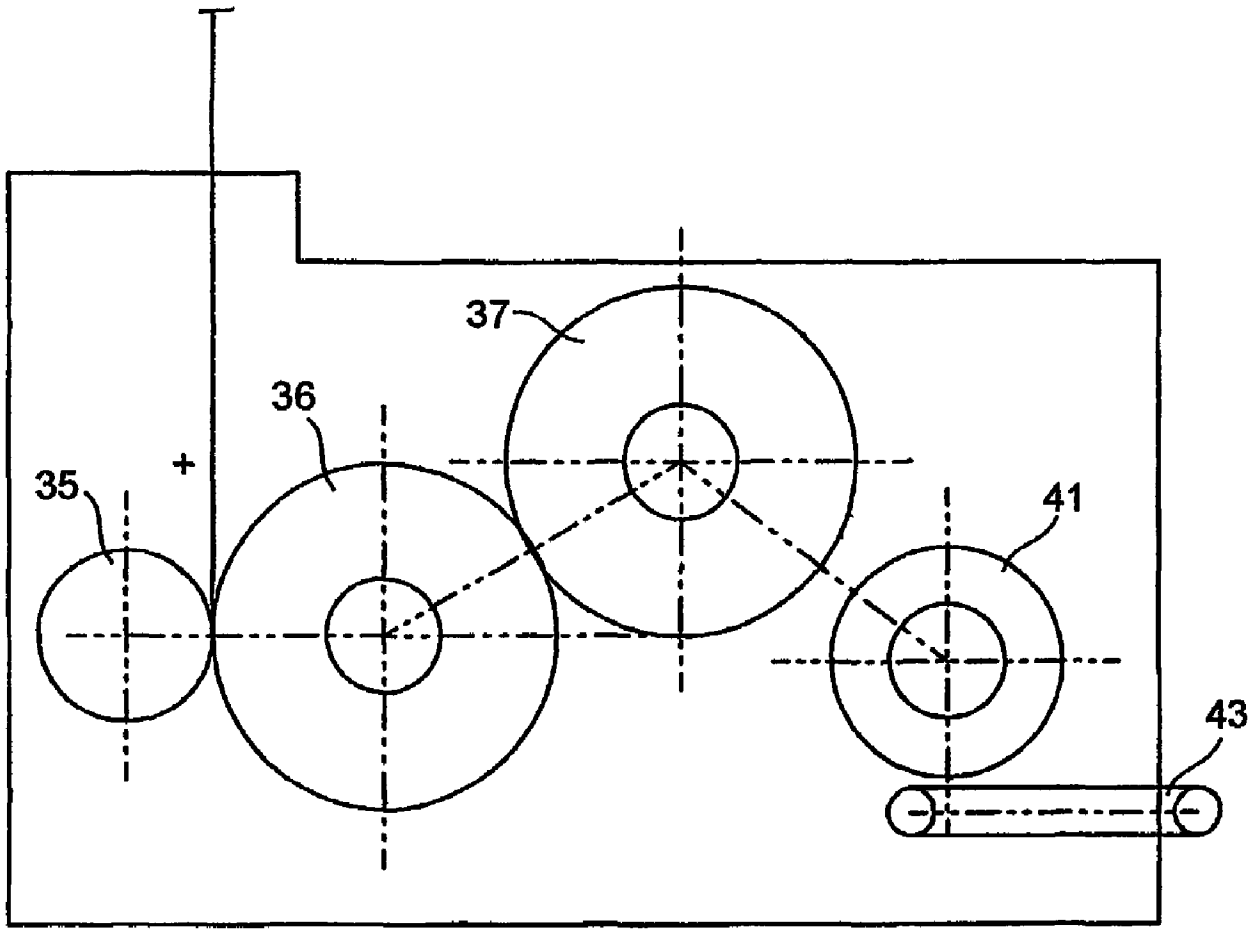
Figure 9:
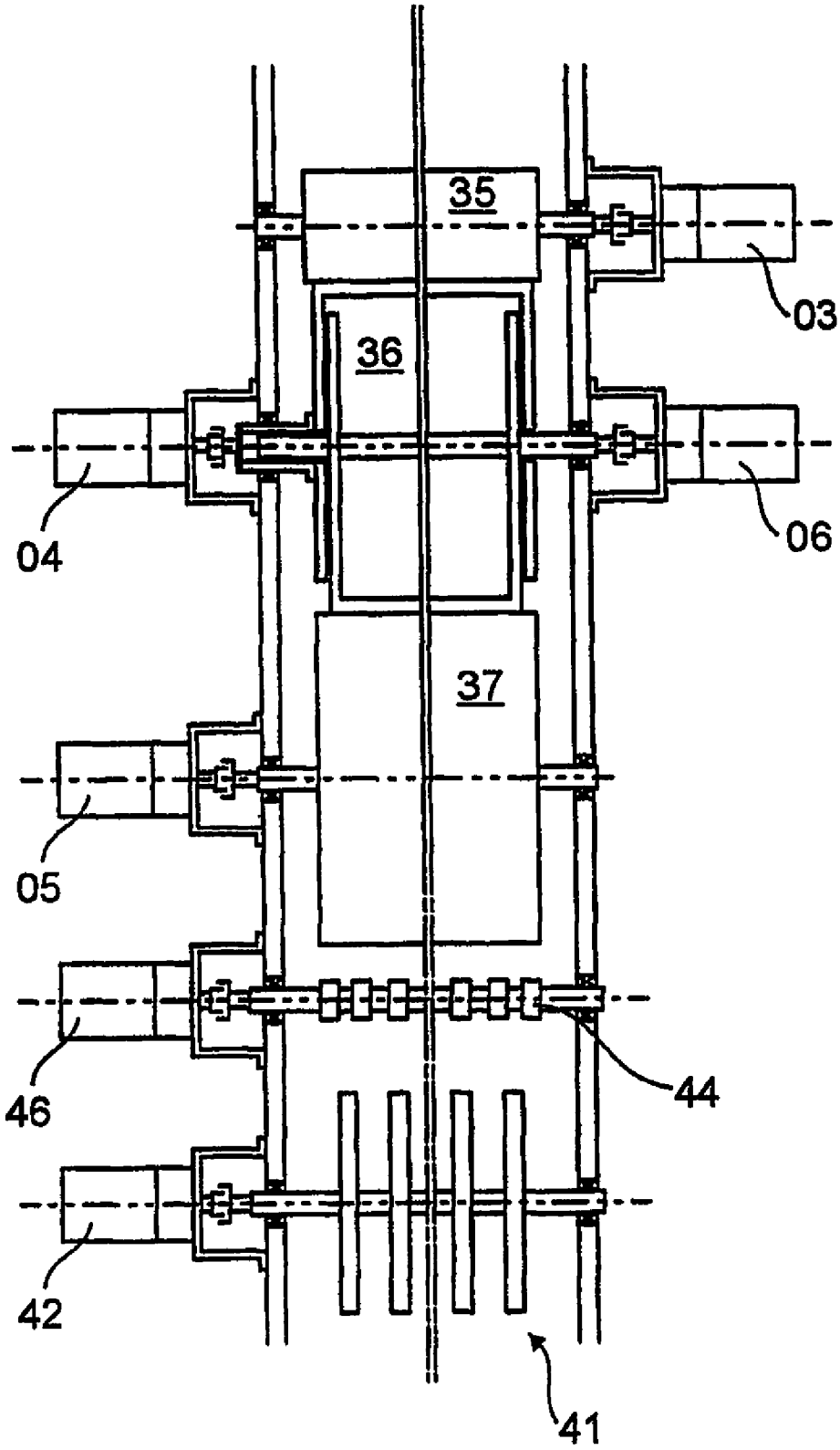
Figure 10:
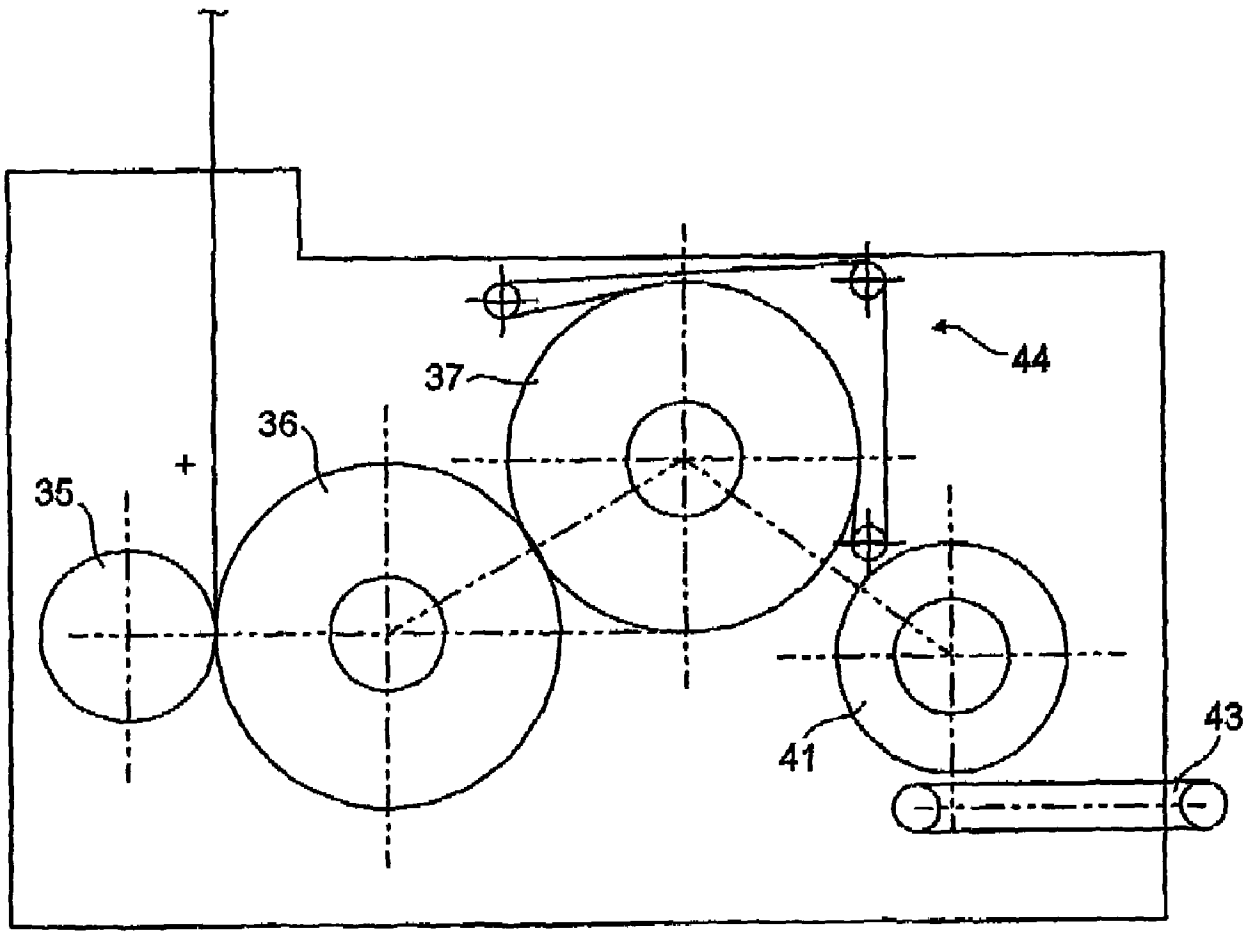
Figure 11:
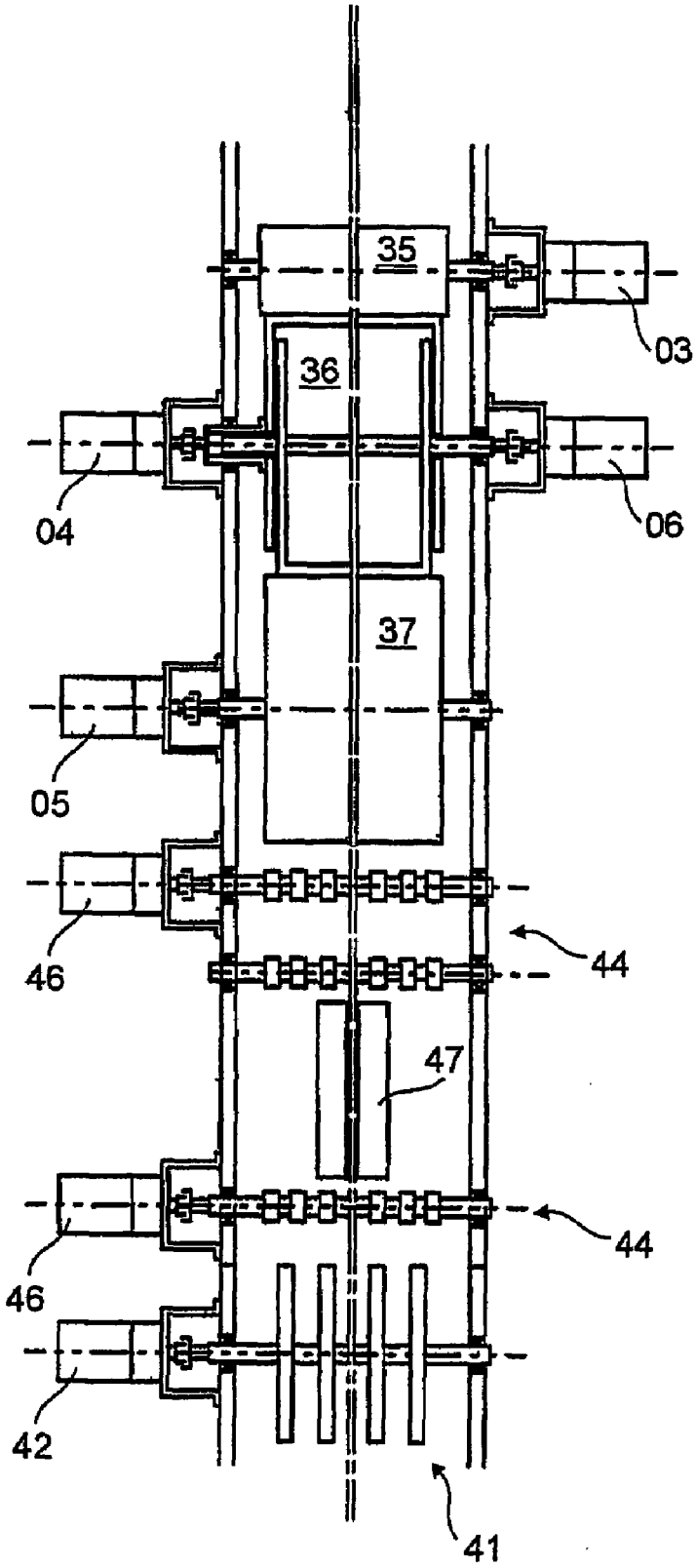
Figure 12:
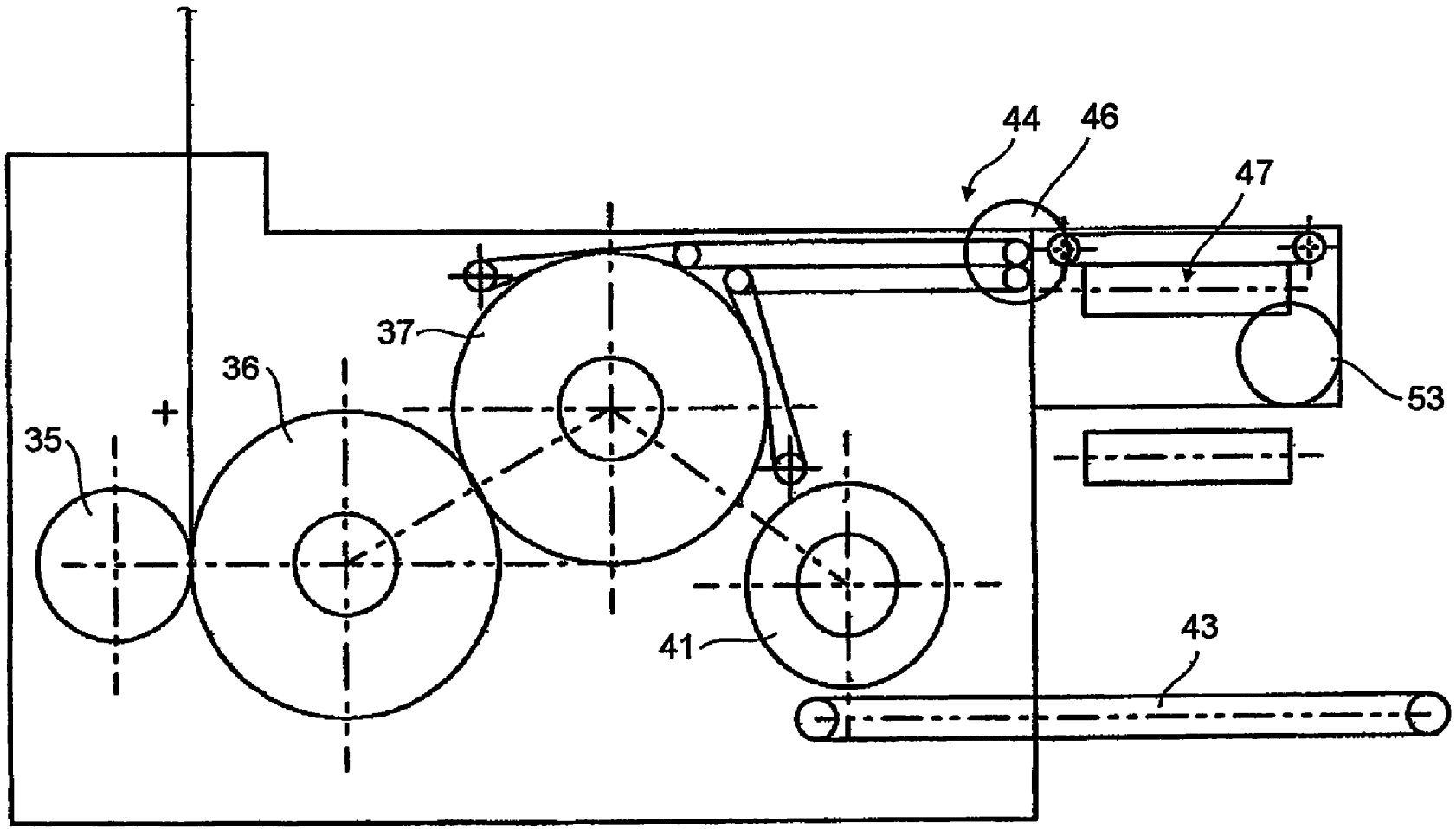
Figure 13:
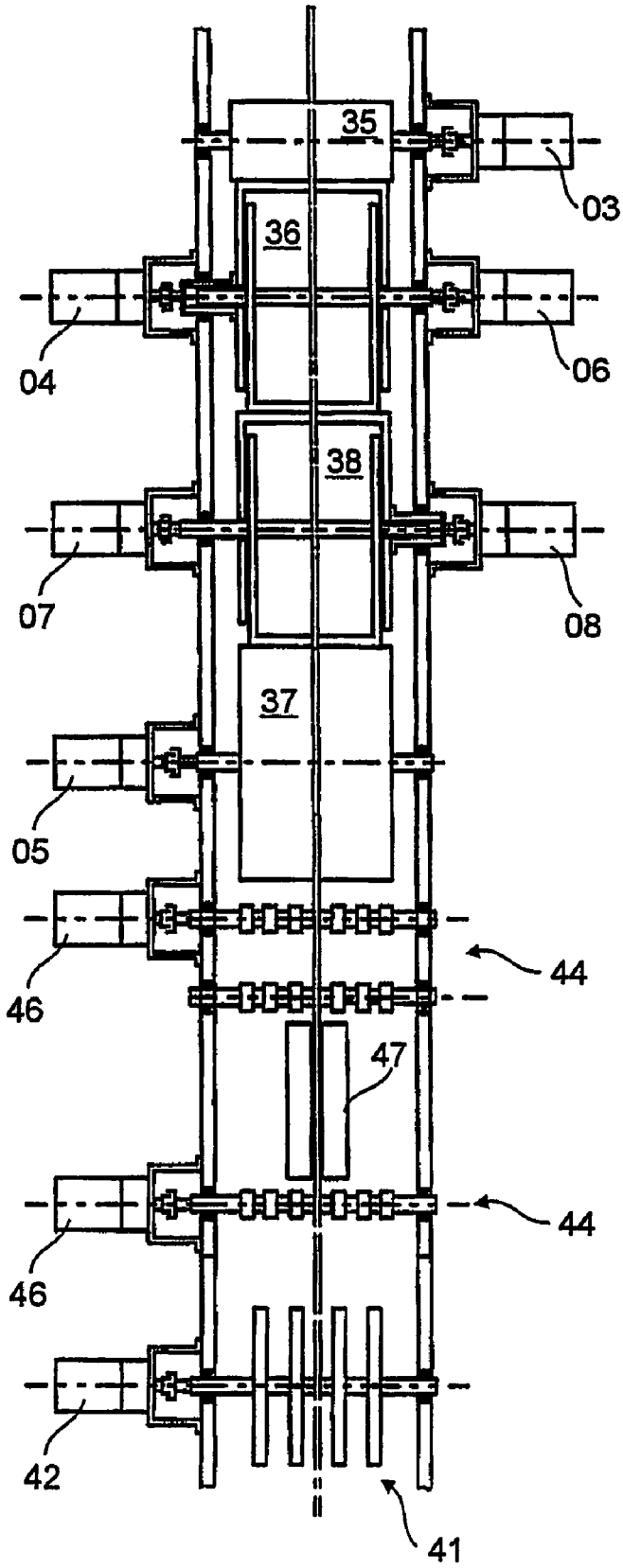
Figure 14:
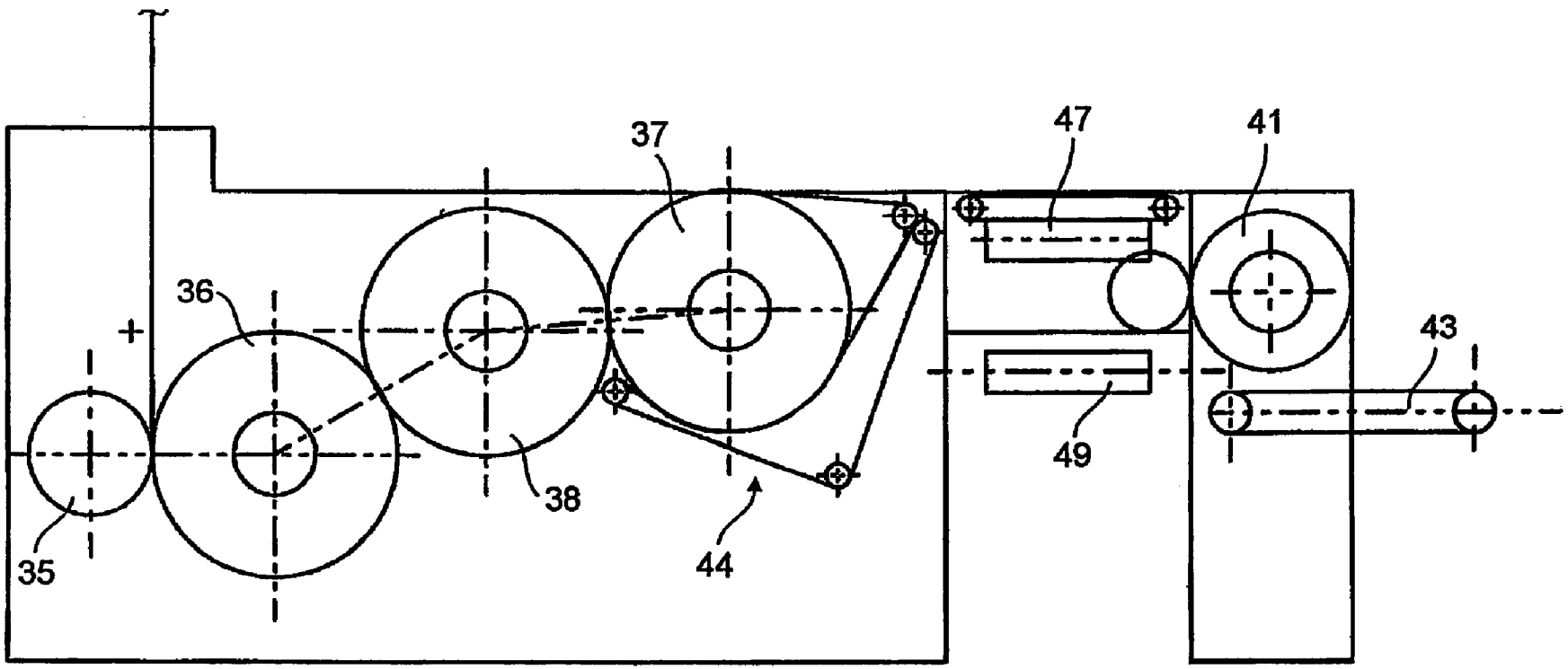

In a further embodiment of the folding device, as depicted in FIGS. 7 and 8, the folding device has at least one bucket wheel 41, which bucket wheel 41 is driven by its own electric motor 42. A belt system 44, as depicted schematically in FIGS. 9 and 10, is provided for the delivery of folded products from the bucket wheel 41 and also has its own electric motor 46. A longitudinal folding arrangement 47, as shown in FIGS. 11 and 12, and which is optionally assigned to the folding device, is also driven by its own electric motor 53 independently of other cylinders, as can be seen in FIGS. 11 and 12. This longitudinal folding arrangement 47 is employed for the formation of a subsequent longitudinal fold, called a third fold or a delta fold, which subsequent longitudinal fold takes place after the formation of the transverse fold. The first longitudinal fold is provided by a longitudinal former, which is not specifically represented. The second, transverse fold is made by a folding jaw cylinder 37 or 38, and the third fold by a further optional folding jaw cylinder 37 or 38. The third fold or the fourth fold is provided by a longitudinal folding blade.

Each cylinder of the folding device is driven by its own electric motor 03, 04, 05, 06, 07, respectively which electric motor for each cylinder is, in its technical gear layout, independent of other cylinders.

In one embodiment of the present invention, at least one electric motor of the folding device is controlled as a function of a virtual guide shaft of the printing press, and at least one other electric motor is controlled as a function of this electric motor. For example, the electric motor 03 of the cutting cylinder 35 is controlled by the virtual guide shaft of the printing press, and an electric motor 04, 06 of the collection cylinder 36 is controlled as a function of the electric motor 03 of the cutting cylinder 35.

The controls of a partial cylinder 40 having a holding system with spur needles and gripper needles, and the controls of the cutting cylinder 35 are independent of each other. This means that the electric motor of the partial cylinder 40 having a holding system with spur needles and gripper needles is controlled as a function of the electric motor 03 of the cutting cylinder 35. Furthermore, the two partial cylinders 01, 02, or 39, 40, or 51, 52 are controlled as a function of each other.

In another embodiment, it is also possible to control all of the electric motors of the folding device as a function of a virtual guide shaft.

A fixing device is provided for each partial cylinder 01, 02, or 39, 40, or 51, 52, as well as for each cylinder. In order to be able to perform maintenance work, the cylinders can be fixed in place relative to the frame in a maintenance position. During the operation, i.e. during the folding process, the two partial cylinders 01, 02, or 39, 40, or 51, 52 are mechanically fixed in respect to each other.

At least one electric motor 03, 04, 05, 06, 07, 08, 17, 26 42, 45, 53 has an angle of rotation sensor.

It is also possible to operate one or both electric motors 04, 06, or 07, 08, or 17, 26 of the partial cylinders 01, 02, or 39, 40, or 51, 52 in a manner where their angular position is controlled only during the adjustment process. After the adjustment process, the two partial cylinders 01, 02, or 39, 40, or 51, 52 are mechanically fixed in place, and at least the position control of the motor 04, 06, or 07, 08, or 17, 26 of a partial cylinder 01, 02, or 39, 40, or 51, 52 is deactivated. The second electric motor 04, 06, 07, 08, 17, 26 can then drive in a moment-controlled manner, or can be disconnected.

While preferred embodiments of a folding device with a first and second partrial cylinder, in accordance with the present invention, have been set forth fully and completely hereinabove, it will be apparent to one of skill in the art that various changes in for example, the overall sizes of the cylinders, the specific structure of the function elements and the like could be made without departing from the true spirit and scope of the present invention which is accordingly to be limited only by the amended claims.

What is claimed is:

1. A folding device comprising:

a first partial cylinder having first radial segments and a first partial cylinder circumference;

a second partial cylinder having second radial segments and a second partial cylinder circumference, said first and second partial cylinders together constituting a body of a cylinder having a cylinder axis of rotation;

means supporting said first partial cylinder and said second partial cylinders coaxially and each for rotation circumferentially about said cylinder axis of rotation and relative to each other;

a first group of function elements on said first partial cylinder circumference;

a second group of function elements on said second partial cylinder circumference;

a separate electric motor for each of said first and second partial cylinders, each of said separate electric motors being mechanically independent of other cylinders and being adapted to coaxially rotatably drive its associated partial cylinder circumferentially about said cylinder axis of rotation; and a drive circuit adapted to drive said electric motors for said first and second partial cylinders at identical speeds to rotate each of said first and second partial cylinders circumferentially about said cylinder axis of rotation and with an adjustable relative phase position between said first and second partial cylinders.

2. The folding device of claim 1 wherein said function elements in each of said first and second group of function elements are identical to each other.

3. The folding device of claim 1 wherein said function elements are selected from the groups including spur needles, sheet grippers, suction strips, folding blades, folding jaws, ejectors, post grippers and cutting blades.

4. The folding device of claim 1 wherein said cylinder is one of a folding blade cylinder, a folding jaw cylinder and a collection cylinder.

5. The folding device of claim 1 wherein said cylinder has first and second longitudinal ends and further wherein said separate drive motors for each of said first and second partial cylinders are connected to respective ones of said first and second longitudinal ends of said cylinder.

6. The folding device of claim 1 wherein said folding device includes a collection cylinder with at least one of said first and second partial cylinders, a folding jaw cylinder and a cutting cylinder.

7. The folding device of claim 6 further including a fixing device for each cylinder.

8. The folding device of claim 7 further including a frame supporting said cylinders and wherein said fixing device is adapted to fix said cylinders in place relative to said frame in a maintenance position.

9. The folding device of claim 6 further including additional separate ones of said electric motors for said folding jaw cylinder and said collection cylinder.

10. The folding device of claim 6 further including a separate electric motor for said cutting cylinder.

11. The folding device of claim 6 further including a separate electric motor for said collection cylinder.

12. The folding device of claim 6 further including a separate electric motor for said folding jaw cylinder.

13. The folding device of claim 6 wherein each of said cylinders is driven by its own one of said separate electric motors which is independent of other cylinders.

14. The folding device of claim 6 further including a longitudinal folding device after, in a direction of travel, of said folding jaw cylinder.

15. The folding device of claim 14 further including an independent electric motor for said longitudinal folding device.

16. The folding device of claim 6 further including a virtual guide shaft and wherein an electric motor of said folding device is controlled as a function of said virtual guide shaft and wherein at least another electric motor is controlled as a function of said electric motor controlled by said virtual guide shaft.

17. The folding device of claim 16 wherein said cutting cylinder electric motor is controlled by said virtual guide shaft.

18. The folding device of claim 16 wherein said collection cylinder electric motor is controlled by said virtual guide shaft.

19. The folding device of claim 6 further including a holding system on one of said first and second partial cylinders and means for controlling said partial cylinder with said holding system and said cuffing cylinder together.

20. The folding device of claim 19 wherein said electric motor for said partial cylinder with said holding system is controlled as a function of said electric motor of said cuffing cylinder.

21. The folding device of claim 1 wherein said folding device includes a folding cylinder, said folding cylinder having said first and second partial cylinders, at least one folding blade on one of said first and second partial cylinders and at least one folding jaw on the other of said first and second partial cylinders.

22. The folding device of claim 1 further including at least one bucket wheel.

23. The folding device of claim 22 further including an electric drive motor for said bucket wheel.

24. The folding device of claim 1 further including at least one belt system.

25. The folding device of claim 24 further including an electric drive motor for said belt system.

26. The folding device of claim 1 wherein said first partial cylinder and said second partial cylinder are controlled dependent on each other.

27. The folding device of claim 1 wherein each said first and second partial cylinders includes a fixing device.

28. The folding device of claim 27 further including a frame supporting said cylinders and wherein said fixing device is adapted to fix said cylinders in place relative to said frame in a maintenance position.

29. The folding device of claim 1 further including means fixing said first and second partial cylinders to each other during operation of said folding device.

30. The folding device of claim 1 further including at least one angle of rotation sensor in at least one of said electric motors.

* * * * *